US011350707B2

(12) United States Patent
Wu

(10) Patent No.: US 11,350,707 B2
(45) Date of Patent: Jun. 7, 2022

(54) ZIP PULLER HOLDER ARRANGEMENT FOR LUGGAGE AND BAGS

(71) Applicant: TUMI, INC., Edison, NJ (US)

(72) Inventor: Peter C. Wu, Sunnyside, NY (US)

(73) Assignee: TUMI, INC., Edison, NJ (US)

( * ) Notice: Subject to any disclaimer, the term of this patent is extended or adjusted under 35 U.S.C. 154(b) by 0 days.

(21) Appl. No.: 17/253,564

(22) PCT Filed: Jun. 20, 2018

(86) PCT No.: PCT/US2018/038597
§ 371 (c)(1),
(2) Date: Dec. 17, 2020

(87) PCT Pub. No.: WO2019/245552
PCT Pub. Date: Dec. 26, 2019

(65) Prior Publication Data

US 2021/0267322 A1 Sep. 2, 2021

(51) Int. Cl.
*A44B 19/30* (2006.01)
*A44B 19/26* (2006.01)
*A45C 13/18* (2006.01)

(52) U.S. Cl.
CPC ..... *A44B 19/30* (2013.01); *A44B 19/262* (2013.01); *A45C 13/18* (2013.01)

(58) Field of Classification Search
CPC ..... A44B 19/30; A44B 19/262; Y10T 24/32
See application file for complete search history.

(56) References Cited

U.S. PATENT DOCUMENTS

| | | | | |
|---|---|---|---|---|
| 3,141,536 | A | 7/1964 | Fulton | |
| 3,325,869 | A | 6/1967 | Younger | |
| 3,971,458 | A | 7/1976 | Koenig | |
| 7,557,727 | B2 * | 7/2009 | Michida | A44B 19/262 116/100 |
| 10,716,379 | B2 * | 7/2020 | Ponti | A45C 13/18 |
| 2003/0066170 | A1 | 4/2003 | Huang | |
| 2004/0237605 | A1 | 12/2004 | Lin et al. | |

(Continued)

FOREIGN PATENT DOCUMENTS

| | | | |
|---|---|---|---|
| CN | 201234621 | Y | 5/2009 |
| CN | 104382302 | A | 3/2015 |
| CN | 204742861 | U | 11/2015 |

(Continued)

OTHER PUBLICATIONS

International Search Report and Written Opinion in International Patent Application No. PCT/US2018/038597 dated Sep. 7, 2018.

(Continued)

*Primary Examiner* — Robert Sandy
(74) *Attorney, Agent, or Firm* — Lando & Anastasi, LLP

(57) ABSTRACT

A luggage article includes a body that includes a zippered opening (15) that has at least one zipper arrangement having a zipper tape (14). The zipper arrangement includes one or more zipper sliders (16, 20) and one or more zipper pull-tabs (18, 22). Each of the one or more zipper sliders (16, 20) is joined to a respective one of the one or more zipper pull-tabs (18, 22). The luggage article includes a means (26) for holding the one or more pull-tabs in a substantially perpendicular arrangement to the zipper tape (14) of the zipper arrangement.

20 Claims, 9 Drawing Sheets

(56) References Cited

U.S. PATENT DOCUMENTS

| | | | |
|---|---|---|---|
| 2012/0246890 | A1 | 10/2012 | Hernandez |
| 2015/0300049 | A1 | 10/2015 | Majeau |

FOREIGN PATENT DOCUMENTS

| | | | |
|---|---|---|---|
| CN | 204812415 | U | 12/2015 |
| CN | 205597390 | U | 9/2016 |
| CN | 205993663 | U | 3/2017 |
| CN | 207236279 | U | 4/2018 |
| DE | 102014019513 | A1 | 6/2016 |
| EP | 1042972 | A1 | 10/2000 |
| EP | 2384660 | A3 | 8/2012 |
| EP | 2710915 | A2 | 3/2014 |
| EP | 2926679 | A1 | 10/2015 |
| WO | 2016100553 | A1 | 6/2016 |

OTHER PUBLICATIONS

Office Action in corresponding Chinese Patent Application No. 201880094855.1 dated Dec. 2, 2021.
Extended European Search Report in corresponding European Patent Application No. 18923229.1 dated Feb. 11, 2022.

* cited by examiner

ZIP PULLER HOLDER ARRANGEMENT FOR LUGGAGE AND BAGS

CROSS-REFERENCE TO RELATED APPLICATIONS

This application is a U.S. National Phase Application, and claims the benefit of priority under 35 U.S.C. § 371, of International (PCT) Patent Application Serial No. PCT/US2018/038597, titled "ZIP PULLER HOLDER ARRANGEMENT FOR LUGGAGE AND BAGS" and filed on Jun. 20, 2018, which is incorporated by reference herein in its entirety for all purposes.

FIELD OF THE INVENTION

The present disclosure relates to a zippered closure for various shapes and sizes of soft shell luggage, hard shell luggage, and other bags. Other bags may include, for example, backpacks, briefcases, suitcases, tote bags, pocket books, purses, messenger bags, duffel bags, sports equipment bags, and the like.

BACKGROUND

Luggage items, and in particular luggage cases (suitcases), often include zippers for various purposes, including for use in opening and closing complimentary luggage shells, as well as for use in opening and closing pockets, among other uses. For some bags, the zipper pull-tabs of a zipper may be secured by a lock mechanism mounted on the luggage case to thwart unauthorized access. Where a zipper has more than one zipper pull-tab, such as having one zipper pull-tab for each of two zipper sliders, the zipper pull-tabs may require specific positioning relative to one another, such as by being interlocked together, in order to be received in the lock mechanism. This relative positioning, or interlocking, of the zipper pull-tabs can be difficult to accomplish for many reasons, such as where the task lighting is inadequate, or where the zipper pull-tabs must be engaged together in a specific manner, such as by being interlocked with the portion of one zipper pull-tab being received in or inserted through a portion of another zipper pull-tab. Additionally, a user may not have the dexterity required for manipulating the zipper pull-tabs into the proper inter-engaged orientation for being received in the lock mechanism.

Documents that may be related to the present disclosure include: EP2926679A1, EP2710915A2, EP2384660A3, WO/2016100553A1, CN104382302A, CN201234621Y, CN205597390U, CN204742861U, and CN204812415U.

EP2384660 discloses a means for operably linking a first zipper slider with either a second zipper slider or an end of a zipper closure. A zipper handle is magnetized to hold it in a predetermined position, which is a position which tends to indicate to a thief that the handle is to be pulled in a certain direction that will not open the zip closure system.

CN204742861 discloses a magnetic zipper with a female magnetic pull-tab and a male magnetic pull-tab that align with each other. The male pull-tab has a magnetic feature and a protrusion on the front side that aligns with a magnetic feature and a cavity on the rear side of the female pull-tab, securing the two pull-tabs together.

CN201234621 discloses a pull tab with a cross beam that extends perpendicularly to the zipper when the pull-tab extends in the direction of the zipper. Each end of the cross beam includes magnets that are attracted to magnets in a lining cloth near an end of the zipper.

CN104382302 discloses a zipper having two sliders, each having a pull-tab that is magnetically attracted to the other pull-tab to prevent the pull-tabs from separating.

CN205597390 discloses a zipper with a first slider that includes a permanent magnet and a second slider that includes a reed switch. The reed switch causes a prompt message to be sent when the first slider and second slider are far away from each other.

CN204812415 discloses a zipper pull-tab that is magnetically held against a magnet that is installed under a bottom stopper of a zipper. The figures show the pull-tab aligned with the direction of the zipper when the pull-tab is magnetically held against the magnet.

WO2016100553 discloses a releasable closure mechanism using an encapsulated magnetic composition that includes a smart fluid or a printable composition with dispersed magnetic particles on one side of an opening, and a similar magnetic composition on the other side. The two magnetic regions attract each other to releasably close the opening. In an embodiment, a supporting substrate has a predetermined pattern of printed magnet segments and a complementary supporting substrate with a predetermined pattern of printed magnet segments. The first supporting substrate may be directly secured to edges of a closeable object, or it could be attached to another structure such as a zipper tape, which is directly attached to the edges of the closeable object.

EP29926679 discloses a zipper with two sliders, each slider with a pull-tab connected to it. The pull-tabs engage a lock on a luggage article.

EP2710915 discloses a zipper with two sliders, each having a pull-tab. The pull-tabs can be interlocked with one another by a slide-and-turn action, turning one pull-tab relative to the other about an axis extending in the longitudinal direction of the zipper.

SUMMARY OF THE INVENTION

It is desirable to provide an improved luggage case, and more specifically an improved zipper-pull retention arrangement that addresses the above-described problems, and/or which more generally offers improvements or an alternative to existing arrangements.

An aspect of this disclosure is directed to a zip puller retention arrangement comprising a first zipper pull-tab, and a means for holding the first zipper pull-tab in a fixed position when not in use. Embodiments can include a zipper arrangement having a zipper tape. Embodiments can also include at least one zipper slider, including a first zipper slider, coupled to the zipper tape and the first zipper pull-tab coupled to the first zipper slider. Embodiments can also include that the means for holding holds the first zipper pull-tab in a substantially perpendicular arrangement to the zipper tape of the zipper arrangement.

According to embodiments of this aspect, the means for holding is a platform, the first pull-tab includes a first zipper magnet, and the platform and the first zipper pull-tab are configured so that the first zipper magnet is held in engagement with an outer surface of the platform by a first magnetic force between the first zipper magnet and the platform. In some embodiments, the platform includes metal.

According to embodiments of this aspect, the means for holding can be a platform having a first positioning magnet coupled to an inner surface of the platform. In addition, the first pull-tab can include a first zipper magnet. With this arrangement the platform and the first pull-tab are configured so that the first zipper magnet is held in engagement with an outer surface of the platform by a first magnetic force between the first zipper magnet and the first positioning magnet.

Embodiments of this aspect can include the first positioning magnet has a first polarity and the first zipper magnet has a second polarity opposite to the first polarity.

Embodiments of this aspect can include the platform has a ridge along a portion of a perimeter of the platform, with the ridge extending outwardly beyond the outer surface of the platform. Embodiments of this aspect can include that the platform is trapezoidal shaped. Embodiments of this aspect can include that the platform has four sides, wherein three of the sides include the ridge and a fourth side does not. Embodiments of this aspect can include the platform being sized and configured so that a first side of the first zipper pull-tab engages with the outer surface of the platform so that the ridge substantially surrounds a periphery of the first zipper pull-tab.

Embodiments of this aspect can include that the platform includes at least one of plastic, leather and a metal.

Embodiments of this aspect can include at least two zipper sliders and at least two zipper pull-tabs, each of the at least two zipper sliders joined to a respective one of the at least two zipper pull-tabs. The first zipper pull-tab is coupled to a first zipper magnet and the second zipper pull-tab is coupled to a second zipper magnet. Embodiments of this aspect can also include the platform that includes a first positioning magnet and a second positioning magnet. With this arrangement, the at least two pull-tabs and the platform are configured so that the first zipper magnet is held in engagement with an outer surface of the platform by a first magnetic force between the first zipper magnet and the first positioning magnet, and the second zipper magnet is held in engagement with the outer surface of the platform by a second magnetic force between the second zipper magnet and the second positioning magnet.

Embodiments of this aspect can include the first positioning magnet has a first polarity and the first zipper magnet has a second polarity opposite to the first polarity; and the second positioning magnet has the second polarity and the second zipper magnet has the first polarity.

Embodiments of this aspect can include each zipper pull-tab comprises an elongated body having a longitudinal axis. Embodiments of this can included that each zipper pull tab is held so that the longitudinal axis extends substantially perpendicular to an edge of the zippered opening when the respective zipper pull-tab is held in engagement with the outer surface of the platform when not in use.

Embodiments of this aspect can also include can include each zipper pull-tab includes a pull-tab frame, a zipper magnet being coupled to the pull-tab frame, and a gripping surface disposed over the zipper magnet and the pull-tab frame. Embodiments of this aspect can also include can include that each zipper magnet is coupled to the pull-tab frame by one or more of a friction fit and an adhesive. Embodiments of this aspect can include that the gripping surface includes rubber. Embodiments of this aspect can include that the rubber is embossed. Embodiments of this aspect can include that the pull-tab frame includes metal.

Embodiments of this aspect can include the platform has a ridge along a portion of a perimeter of the platform, with the ridge extending outwardly beyond the outer surface of the platform. Embodiments of this aspect can include that the platform is trapezoidal shaped. Embodiments of this aspect can include that the platform has four sides, wherein three of the sides include the ridge and a fourth side does not. Embodiments of this aspect can include the platform is sized and configured so that a first side of the first zipper pull-tab engages with the outer surface of the platform so that the ridge substantially surrounds a periphery of the first zipper pull-tab.

Embodiments of this aspect can include the platform being sized and configured so that a first side of the first zipper pull-tab engages with the outer surface of the platform and so that a first side the second zipper pull-tab engages with the outer surface of the platform so that the ridge substantially surrounds a periphery of the first zipper pull-tab and the second zipper pull-tab.

Embodiments of this aspect can include that the platform is mounted to a luggage article proximate to a zippered opening, the luggage article including a body having an outer surface, the body including the zippered opening secured by a zipper tape. Embodiments of this aspect can include that the platform is secured to the outer surface of the body. Embodiments of this aspect can include that the platform is mounted to a side panel of the outer surface of the body so as to retain the first pull-tab or the at least two pull-tabs in a substantially perpendicular arrangement to the zipper tape. Embodiments of this aspect can include that the platform the platform is secured to the outer surface of the body by one of stitching and an adhesive.

Embodiments of this aspect can include that the luggage article includes an inner lining that is secured to an inner surface of the body, with the first positioning magnet or the at least two positioning magnets being disposed between the inner surface of the platform and the inner lining.

Embodiments of this aspect can include that the luggage article is any of a suitcase, a backpack, a briefcase, a handbag, a messenger bag, a duffel bag, and a sports equipment bag.

According to one aspect of the present disclosure, an improved luggage article is provided. The improved luggage article comprises a body having an outer surface and a zippered opening that has at least one zipper arrangement having a zipper tape. The zipper arrangement includes at least one zipper slider and at least one zipper pull-tab joined to a respective zipper slider. In some embodiments, the at least one zipper slider includes a first zipper slider and a second zipper slider and at least one zipper pull-tab includes a first zipper pull-tab and a second zipper pull-tab, and the luggage article also includes means for holding the at least two pull-tabs in a substantially perpendicular arrangement to the zipper tape of the zipper arrangement when the pull-tabs are not in use.

In some embodiments, the means for holding comprises the first zipper pull-tab coupled to a first zipper magnet; the second zipper pull-tab coupled to a second zipper magnet. Each of first zipper magnet and the second zipper magnet may be magnetically attracted to a metal platform, which may or may not include magnets. In some embodiments, the means for holding further comprises a platform secured to the outer surface of the body comprising at least two positioning magnets coupled to an inner surface of the platform, the at least two positioning magnets including a first positioning magnet and a second positioning magnet. With this arrangement the at least two pull-tabs and the platform are configured so that the first zipper magnet is held in engagement with an outer surface of the platform by a first magnetic force between the first zipper magnet and the first positioning magnet, and the second zipper magnet is held in engagement with the outer surface of the platform by a second magnetic force between the second zipper magnet and the second positioning magnet.

In some embodiments, the first positioning magnet has a first polarity and the first zipper magnet has a second polarity opposite to the first polarity, and the second positioning magnet has the second polarity and the second zipper magnet has the first polarity.

In some embodiments, each zipper pull-tab comprises an elongated body having a longitudinal axis that extends substantially perpendicular to an edge of the zippered opening when the respective zipper pull-tab is held in engagement with the outer surface of the platform.

In some embodiments, the platform is secured to the outer surface of the body.

In some embodiments, the platform is secured to the outer surface of the body by one of stitching and an adhesive.

In some embodiments, the platform has a ridge along a portion of a perimeter of the platform, the ridge extending outwardly beyond the outer surface of the platform.

In some embodiments, the platform is trapezoidal shaped.

In some embodiments, the platform has four sides, wherein three of the sides include the ridge and a fourth side does not, wherein the platform is sized and configured so that a first side of the first zipper pull-tab and a first side the second zipper pull-tab engage with the outer surface of the platform in a side-by-side arrangement and the ridge substantially surrounds a periphery of the first and second zipper pull-tabs.

In some embodiments, the luggage article further comprises an inner lining of the body that is secured to an inner surface of the body, wherein the at least two positioning magnets are disposed between the inner surface of the platform and the inner lining.

In some embodiments, each zipper pull-tab includes a pull-tab frame, the respective zipper magnet being coupled to the pull-tab frame; and a gripping surface is disposed over the respective zipper magnet and the pull-tab frame. In some embodiments the gripping surface is overmolded over the respective zipper magnet and pull-tab frame.

In some embodiments, each respective zipper magnet is coupled to the respective pull-tab frame by one or more of a friction fit and an adhesive.

In some embodiments, the gripping surface includes rubber. In some embodiments, the rubber is embossed. In some embodiments, the pull-tab frame includes metal.

In some embodiments, the platform includes at least one of plastic, metal, and leather.

In some embodiments, the at least two zipper pull-tabs is two zipper pull-tabs.

In some embodiments, the body is in the form of one of a suitcase, a backpack, a briefcase, a handbag, a messenger bag, a duffel bag, and a sports equipment bag.

In some embodiments, the platform is mounted to a side panel of the outer surface of the body so as to retain the at least pull-tabs in a substantially perpendicular arrangement to the zipper tape of the zipper arrangement.

According to another aspect of the present disclosure, a luggage article comprises a body having an outer surface, the body including a zippered opening secured by at least one zipper arrangement. The zipper arrangement includes at least two zipper sliders and at least two zipper pull-tabs. Each of the at least two zipper sliders is joined to a respective one of the at least two zipper pull-tabs. The at least two zipper pull-tabs include a first zipper pull-tab and a second zipper pull-tab. The first zipper pull-tab comprises a first zipper magnet and the second zipper pull-tab comprises a second zipper magnet. The luggage article also includes a platform secured to the outer surface of the body comprising at least two positioning magnets adjacent an inner surface of the platform. The at least two positioning magnets including a first positioning magnet and a second positioning magnet. The at least two pull-tabs and the platform are configured so that the first zipper magnet is held in engagement with an outer surface of the platform by a first magnetic force between the first zipper magnet and the first positioning magnet, and the second zipper magnet is held in engagement with the outer surface of the platform by a second magnetic force between the second zipper magnet and the second positioning magnet.

In some embodiments, the first positioning magnet has a first polarity and the first zipper magnet has a second polarity opposite to the first polarity, and the second positioning magnet has the second polarity and the second zipper magnet has the first polarity.

In some embodiments, each zipper pull-tab comprises an elongated body having a longitudinal axis that extends substantially perpendicular to an edge of the zippered opening when the respective zipper pull-tab is held in engagement with the outer surface of the platform.

In some embodiments, the platform is secured to the outer surface of the body. In some embodiments, the platform is secured to the outer surface of the body by one of stitching and an adhesive.

In some embodiments, the platform has a ridge along a portion of a perimeter of the platform, the ridge extending outwardly beyond the outer surface of the platform.

In some embodiments, the platform is trapezoidal shaped.

In some embodiments, the platform has four sides, wherein three of the sides include the ridge and a fourth side does not, wherein the platform is sized and configured so that a first side of the first zipper pull-tab and a first side the second zipper pull-tab engage with the outer surface of the platform in a side-by-side arrangement and the ridge substantially surrounds a periphery of the first and second zipper pull-tabs.

In some embodiments, the luggage article further comprises an inner lining of the body that is secured to an inner surface of the body, wherein the at least two positioning magnets are disposed between the inner surface of the platform and the inner lining.

In some embodiments, each zipper pull-tab includes a pull-tab frame, the respective zipper magnet being coupled to the pull-tab frame. In some embodiments a gripping surface is disposed over the respective zipper magnet and the pull-tab frame. In some embodiments the gripping surface is disposed over the respective zipper magnet and pull-tab frame.

In some embodiments, each respective zipper magnet is coupled to the respective pull-tab frame by one or more of a friction fit and an adhesive.

In some embodiments, the gripping surface includes rubber. In some embodiments, the rubber is embossed.

In some embodiments, the pull-tab frame includes metal.

In some embodiments, the platform includes at least one of plastic, metal, and leather.

In some embodiments, the at least zipper two pull-tabs is two zipper pull-tabs.

In some embodiments, the body is in the form of one of a suitcase, a backpack, a briefcase, a handbag, a messenger bag, a duffel bag, and a sports equipment bag.

In some embodiments, the platform is mounted to a side panel of the outer surface of the body so as to retain the at least pull-tabs in a substantially perpendicular arrangement to zipper tapes of the zipper arrangement.

According to another aspect of the present disclosure, a method of assembling a luggage article, the method comprises providing a body having an outer surface, the body including a zippered opening that has at least one zipper arrangement having a zipper tape, the zipper arrangement including at least two zipper sliders and at least two zipper pull-tabs, each of the at least two zipper sliders joined to a respective one of the at least two zipper pull-tabs, the at least two zipper pull-tabs including a first zipper pull-tab and a second zipper pull-tab; and providing means for holding the at least two pull-tabs in a substantially perpendicular arrangement to the zipper tape of the zipper arrangement.

In some embodiments, providing the means for holding comprises coupling the first zipper pull-tab to a first zipper magnet; coupling the second zipper pull-tab to a second zipper magnet; securing a platform to the outer surface of the body, the platform comprising at least two positioning magnets coupled to an inner surface of the platform, the at least two positioning magnets including a first positioning magnet and a second positioning magnet; and configuring the at least two pull-tabs and the platform so that the first zipper magnet is held in engagement with an outer surface of the platform by a first magnetic force between the first zipper magnet and the first positioning magnet, and the second zipper magnet is held in engagement with the outer surface of the platform by a second magnetic force between the second zipper magnet and the second positioning magnet.

In some embodiments, the first positioning magnet has a first polarity and the first zipper magnet has a second polarity opposite to the first polarity, and the second positioning magnet has the second polarity and the second zipper magnet has the first polarity.

In some embodiments, each zipper pull-tab comprises an elongated body having a longitudinal axis that extends substantially perpendicular to an edge of the zippered opening when the respective zipper pull-tab is held in engagement with the outer surface of the platform.

In some embodiments, the method further comprises securing the platform to the outer surface of the body.

In some embodiments, the method further comprises securing the platform to the outer surface of the body by one of stitching and an adhesive.

In some embodiments, the platform has a ridge along a portion of a perimeter of the platform, the ridge extending outwardly beyond the outer surface of the platform.

In some embodiments, the platform is trapezoidal shaped.

In some embodiments, the platform has four sides, wherein three of the sides include the ridge and a fourth side does not, wherein the platform is sized and configured so that a first side of the first zipper pull-tab and a first side the second zipper pull-tab engage with the outer surface of the platform in a side-by-side arrangement and the ridge substantially surrounds a periphery of the first and second zipper pull-tabs.

In some embodiments, the method further comprises securing an inner lining of the body to an inner surface of the body; and disposing the at least two positioning magnets between the inner surface of the platform and the inner lining.

In some embodiments, the method further comprises providing a pull-tab frame in each zipper pull-tab and coupling the respective zipper magnet being to the pull-tab frame, and overmolding a gripping surface over the respective zipper magnet and the pull-tab frame.

In some embodiments, the method further comprises coupling each respective zipper magnet to the respective pull-tab frame by one or more of a friction fit and an adhesive.

In some embodiments, the gripping surface includes rubber. In some embodiments, the method further comprises embossing the rubber. In some embodiments, the pull-tab frame includes metal. In some embodiments, the platform includes at least one of plastic, metal, and leather.

In some embodiments, the at least two zipper pull-tabs is two zipper pull-tabs.

In some embodiments, providing the body further comprises providing the body in the form of one of a suitcase, a backpack, a briefcase, a handbag, a messenger bag, a duffel bag, and a sports equipment bag.

In some embodiments, the method further comprises mounting the platform to a side panel of the outer surface of the body so as to retain the at least pull-tabs in a substantially perpendicular arrangement to the zipper tape of the zipper arrangement.

According to another aspect of the present disclosure, a method of retaining at least one zipper pull-tab against a luggage article includes attracting a first zipper pull-tab to a platform with a first magnetic force. Embodiments of this aspect can include attracting a second zipper pull-tab to the platform with a second magnetic force. Embodiments of this aspect can include attracting the first zipper pull-tab and the second zipper pull-tab to the platform so the first zipper pull-tab and the second zipper pull-tab are held in a side-by-side arrangement against the platform when the first zipper pull-tab and the second zipper pull-tab are not in use.

In some embodiments of the aspect, the method further comprises securing the platform to a surface of a luggage article having a pocket with a zippered opening.

In some embodiments of the aspect, attracting the first zipper pull-tab further comprises attracting the first zipper pull-tab so that a longitudinal axis of the first zipper pull-tab extends substantially perpendicular to the edge of the zippered opening of the luggage article, and attracting the second zipper pull-tab further comprises attracting the second zipper pull-tab so that a longitudinal axis of the second zipper pull-tab extends substantially perpendicular to the edge of the zippered opening of the luggage article.

In some embodiments of the aspect, the method further comprises providing a ridge that substantially surrounds a periphery of the first zipper pull-tab and the second zipper pull-tab when the first zipper pull-tab and the second zipper pull-tab are not in use.

BRIEF DESCRIPTION OF THE DRAWINGS

Various aspects of at least one embodiment are discussed below with reference to the accompanying figures. The figures are provided for the purposes of illustration and explanation and are not intended as a definition of the limits of the invention. In the figures.

LIST OF REFERENCE NUMERALS UTILIZED IN THE DRAWINGS

Figure 1:
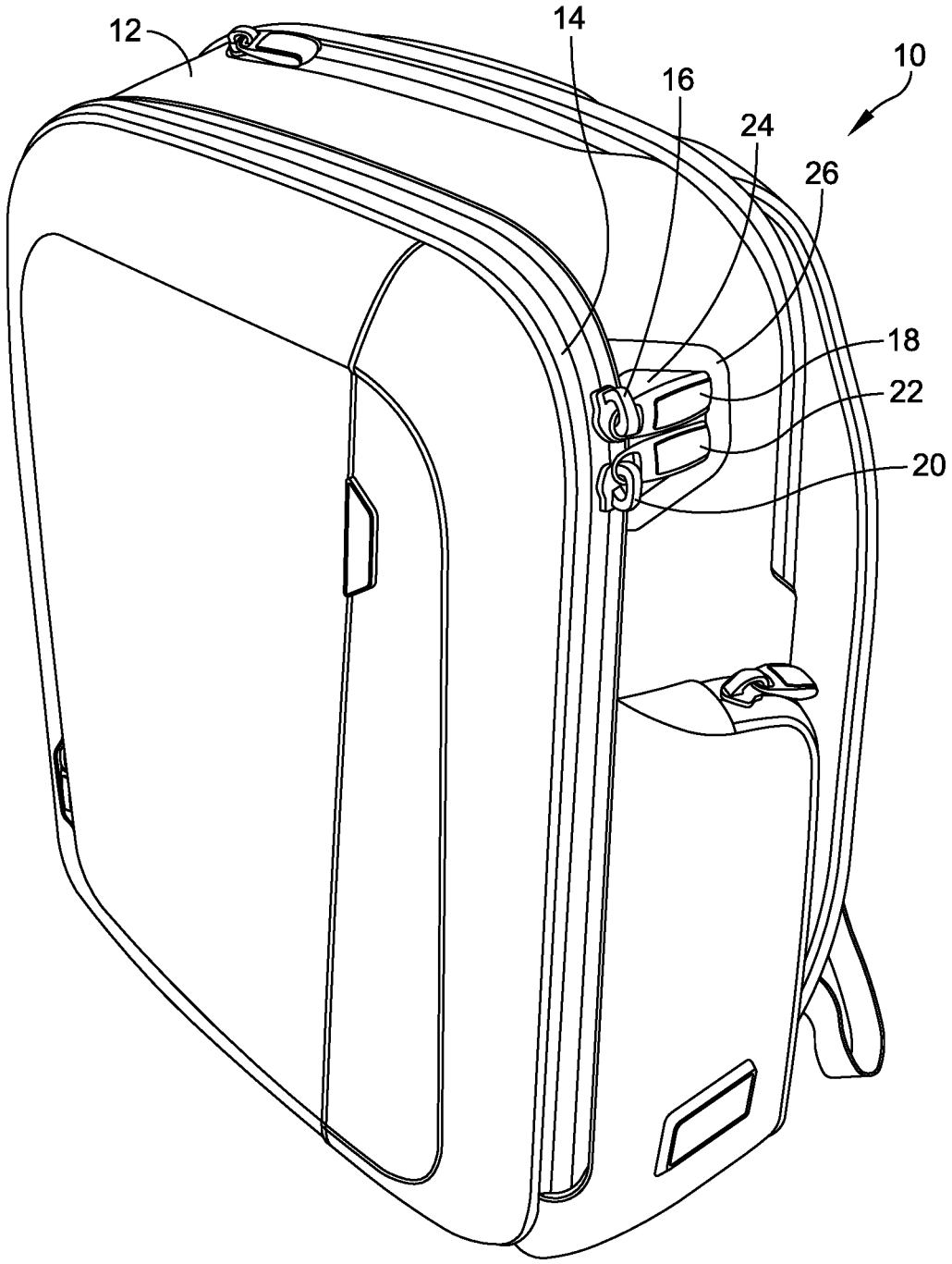
FIG. 1 is a perspective view of a backpack including a zip puller retention arrangement of the disclosure.

With regard to reference numerals used, the following numbering is used throughout the description and drawings. Where technical features in the figures or detailed description are followed by these reference numerals, the reference numerals have been included for the sole purpose of increasing the intelligibility of the figures or detailed description. Accordingly, neither the reference numerals nor their absence is intended to have any limiting effect on the scope of any claim elements. In the figures, each identical or nearly identical component that is illustrated in various figures is represented by a like numeral. For purposes of clarity, not every component may be labeled in every figure.

Reference numeral 10 refers to backpack.

Reference numeral 12 refers to an outer surface of the backpack 10.

Reference numeral 14 refers to a zipper tape.

Reference numeral 15 refers to a first zippered opening.

Reference numeral 16 refers to a first zipper slider.

Reference numeral 18 refers to a first zipper pull-tab.

Reference numeral 20 refers to a second zipper slider.

Reference numeral 22 refers to a second zipper pull-tab.

Reference numeral 24 refers to an outer surface of a platform 26.

Reference numeral 26 refers to a platform.

Reference numeral 28 refers to a ridge.

Reference numeral 30 refers to a perimeter of the platform.

Reference numeral 32 refers to a first platform magnet.

Reference numeral 34 refers to a second platform magnet.

Reference numeral 36 refers to an inner surface of the platform 26.

Reference numeral 38 refers to a lining.

Reference numeral 50 refers to a zipper pull-tab frame.

Reference numeral 52 refers to longitudinally extending frame portions.

Reference numeral 54 refers to a laterally extending frame portion.

Reference numeral 56 refers to a surface of a zipper pull-tab frame.

Reference numeral 58 refers to a zipper magnet.

Reference numeral 60 refers to a zipper pull-tab body.

Reference numeral 62 refers to an overmolding.

Reference numeral 64 refers to a textured surface.

Reference letter L is a length dimension of a zipper pull-tab.

Reference letter W is a width dimension of a zipper pull-tab.

DETAILED DESCRIPTION

Reference will now be made in detail to representative embodiments illustrated in the accompanying drawings. It should be understood that the following descriptions are not intended to limit the embodiments to one preferred embodiment. To the contrary, they are intended to cover alternatives, modifications, and equivalents as may be included within the spirit and scope of the described embodiments as defined by the appended claims.

The present disclosure relates to a zip puller retention arrangement to hold a zipper pull-tab in a substantially perpendicular orientation to a zipper tape and to provide a convenient location for at least one zipper pull-tab. In one embodiment, a zipper arrangement includes a platform that can be secured to a luggage article that includes at least one magnet to magnetically attract at least one zipper pull-tab. In some embodiments, each zipper pull-tab includes a magnet that has a polarity that attracts to at least one magnet in the platform.

For the purpose of explanation and illustration, and not limitation, FIG. 1 shows a perspective view of a body of a backpack 10 that the zip puller retention arrangement of this disclosure can be used with. It is to be appreciated that the backpack is one example of a luggage article that the zip puller retention arrangement can be used with, and that the zip puller retention arrangement can be used with a number of articles such as backpacks, briefs, briefcases, luggage items and any other items that include a zipper enclosure. The backpack 10 has an outer surface 12 and a zipper tape 14 extending along a perimeter of a first zippered opening 15 that allows an individual to access a first interior portion of the backpack 10. As illustrated in this embodiment, the zipper tape 14 extends over a first side, a top, and a second side of the backpack 10 to provide a pocket closure. In other embodiments, a zipper tape extends over at least one side of the luggage article. In some embodiments, a zipper tape extends over only one side of the luggage article. The zipper tape may be selected from various zipper tapes commonly used in luggage articles. The zipper tape includes teeth. In some embodiments, the teeth are made of plastic, metal, and/or another material.

In some embodiments, the zipper arrangement includes at least two zipper sliders that travel along the zipper tape to open and close the zippered opening and at least two zipper pull-tabs, with each of the zipper sliders joined to a respective one of the zipper pull-tabs. It is to be appreciated that any zipper tape arrangement is contemplated.

FIG. 1 shows a first zipper slider 16 joined to a first zipper pull-tab 18 and a second zipper slider 20 joined to a second zipper pull-tab 22. To move the first zipper slider 16 along the zipper tape 14, an individual may pull the first zipper pull-tab 18 in a direction along the zipper tape 14. To move the second zipper slider 20 along the zipper tape 14, an individual may pull the second zipper pull-tab 22 in a direction along the zipper tape 14.

In FIG. 1, the zipper arrangement is illustrated as closed, with the first zipper pull-tab 18 and the second zipper pull-tab 22 securely held adjacent each other on a platform 26. In at least one embodiment, the first zipper pull-tab 18 and the second zipper pull-tab 22 are magnetically held in engagement with an outer platform surface 24 of the platform 26 that is secured to an outer surface 12 of the backpack 10. In various embodiments, the platform 26 may be secured to the outer surface 12 of the backpack 10 by an adhesive, stitching, or another means of securing. In some embodiments, the adhesive is glue.

As illustrated, the first zipper pull-tab 18 is held in an orientation that is substantially perpendicular to the orientation of the zipper tape 14. In particular, the first zipper pull-tab 18 has an elongated body having a longitudinal axis along a length L of the zipper pull-tab that is held substantially perpendicular to an edge of the zippered opening 15 when the first zipper pull-tab 18 is held in engagement with the outer surface 24 of the platform 26. Similarly, the second zipper pull-tab 22 is held in an orientation that is substantially perpendicular to the orientation of the zipper tape 14. In particular, the second zipper pull-tab 22 has an elongated body having a longitudinal axis along a length L of the zipper pull-tab that extends substantially perpendicular to an edge of the zippered opening when the second zipper pull-tab 22 is held in engagement with the outer surface 24 of the platform 26.

In some embodiments, the platform 26 is mounted to a panel, such as a side panel, of the outer surface of the body of the luggage article so as to retain the zipper pull-tabs in a substantially perpendicular arrangement to a zipper tape of the zipper arrangement. For example, the platform may be on a side, top, front, or another surface of the luggage article.

The platform 26 is shown on a side surface of the backpack 10 in FIG. 1. In some embodiments, the platform 26 is configured for magnetically retaining the first zipper pull-tab 18 and the second zipper pull-tab 22 so as to provide a fixed, convenient, user friendly location for the zipper pull-tabs, rather than having the zipper pull-tabs simply hang from the side of the backpack 10 due to gravity when the backpack 10 is in an upright position, such as illustrated in FIG. 1.

The platform 26 includes an outer surface 24 that is sized and configured to engage and hold the first zipper pull-tab 18 and is sized and configured to engage and hold the second zipper pull-tab 22. As shown in FIG. 1, the platform 26 allows the first zipper pull-tab 18 and the second zipper pull-tab 22 to be held in side-by-side arrangement on the platform 26. In various embodiments, the outer surface 24 of the platform 26 is made of a material such as plastic, metal, leather, and/or another material. It is appreciated that any material that is common in the art can be used. In various embodiments, the entire platform 26 is made of a material such as plastic, metal, leather, and/or another material.

Figure 2:
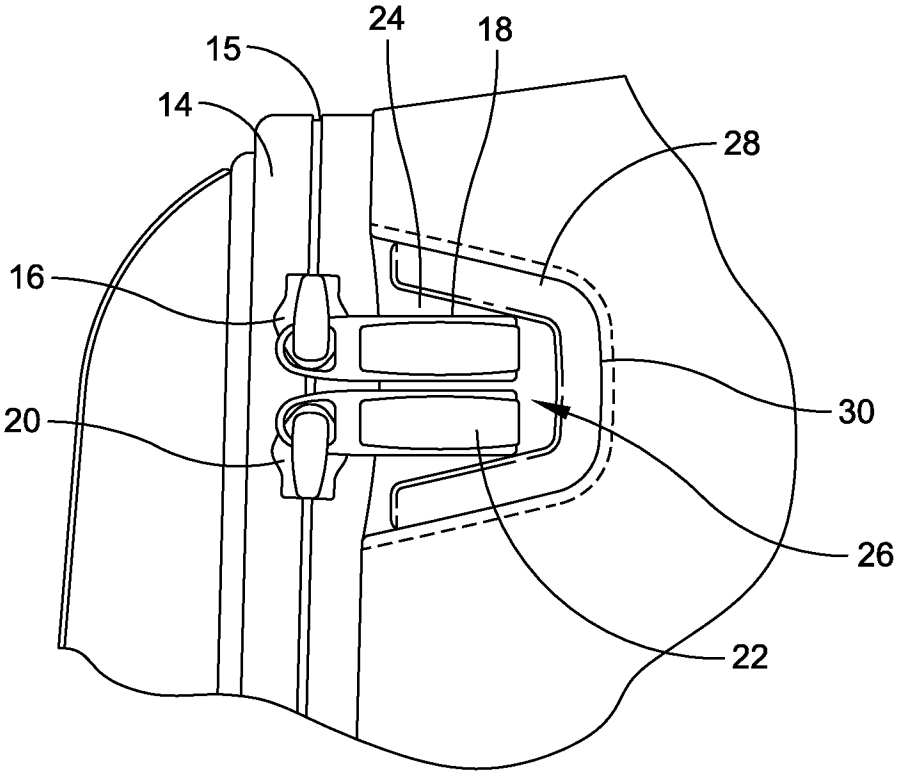
FIG. 2 is an enlarged view of the zip puller retention arrangement including a platform secured to the backpack of FIG. 1.

FIG. 2 shows an enlarged view of the zip puller retention arrangement of FIG. 1. In FIG. 2, the outer surface 24 of the platform 26 is illustrated as substantially flat. In some embodiments, the outer surface of the platform may match a curvature of the luggage article to which the platform is secured. In some embodiments, the outer surface 24 of the platform 26 may be recessed from the outer surface of the luggage article to which it is secured. In some embodiments, the platform may be flush with the outer surface of the luggage article.

In some embodiments, the platform includes a ridge to limit movement of the zipper pull-tabs on the platform. In FIG. 2, the platform 26 includes a ridge 28 along a portion of the perimeter 30 of the platform 26. In some embodiments, the platform has four sides, and three of the sides include the ridge but a fourth side does not. In some embodiments, the platform is sized and configured so that a first zipper pull-tab and a second zipper pull-tab engage with the outer surface of the platform in a side-by-side arrangement, and the ridge substantially surrounds a periphery of the first and second zipper pull-tabs.

In FIG. 2, the shape of the platform including its perimeter 30 is trapezoidal. As shown in FIG. 2, in some embodiments the ridge 28 extends along three sides of the perimeter 30 of the platform.

In some embodiments, the ridge may be configured and dimensioned to help retain the zipper pull-tabs on the platform. For example, in some embodiments, the ridge is dimensioned to prevent rotation of the zipper tabs in a plane of the outer surface of the platform when the zipper tabs are held against the platform. In some embodiments, the ridge is sloped and has a sufficient height such that an object sliding along the outer surface of the luggage towards the ridge would have to slide up the ridge, thereby preventing the object from causing one or more of the zipper pull-tabs to come out of magnetic engagement with the platform. Similarly, the ridge is sized and configured to prevent the zipper pull-tabs from sliding up and over the ridge beyond the periphery of the platform.

In various embodiments, the platform is configured to support at least one zipper pull-tab. In some embodiments, the platform is configured to support at least two zipper pull-tabs. In some embodiments, the platform is configured to support zipper pull-tabs from more than one zippered opening. For example, a single platform may be configured to support four zipper pull-tabs including two zipper pull-tabs from a first zippered opening and two zipper pull-tabs from a second zippered opening.

Each zipper pull-tab can be held against the outer surface of the platform by a means for holding the zipper pull-tab substantially perpendicularly to the zipper tape of the zipper arrangement. In some embodiments, this means for holding the zipper pull-tab is magnetic. In some embodiments, the means for holding the zipper pull-tab is a magnetic force from at least one magnet of the platform. In some embodiments, the means for holding the pull-tab is a magnetic force from at least one magnet of the platform and at least one magnet of the zipper pull-tab.

Figure 3:
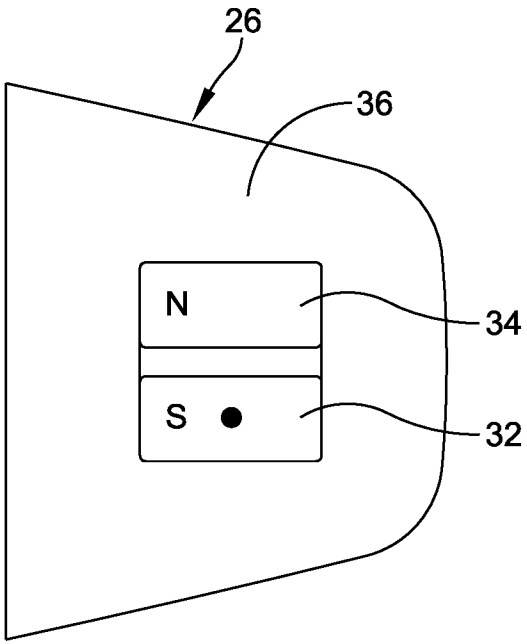
FIG. 3 is a view of the magnets coupled to an inner surface of the platform.

FIG. 3 shows an embodiment of the platform of FIG. 2. In the platform of FIG. 3, platform magnets 32, 34 are coupled to the platform 26. In some embodiments, the platform magnets are located adjacent an inner surface of the platform 26, which is opposite the outer surface 24 of the platform 26. In particular, FIG. 3 shows a first platform magnet 32 and a second platform magnet 34 secured to an inner surface 36 of the platform 26. Each platform magnet 32, 34 may be secured to the inner surface 36 of the platform 24 by an adhesive, a magnetic force, or another fastening means that is used in the art.

Figure 4:
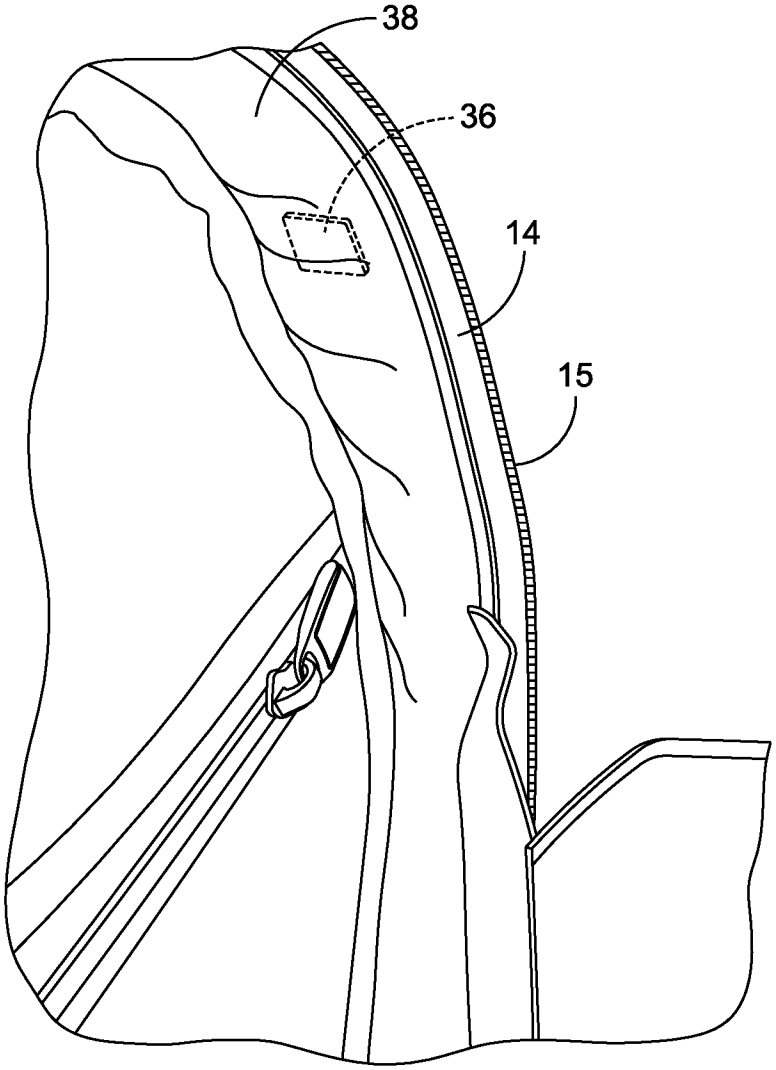
FIG. 4 is a perspective view of an interior of the backpack of FIG. 1.

FIG. 4 is a perspective view of an interior of the backpack of FIG. 1. In the backpack 10, the platform magnets 32, 34 can be disposed between the inner surface 36 of the platform 26 and a lining 38 of the backpack. With this arrangement, the platform magnets 32, 34 are separated from an interior pocket of the backpack 10 by the lining 38.

Each platform magnet 32, 34 is oriented and configured to magnetically retain a respective zipper pull-tab of the zipper pull-tabs 18, 22 against the outer surface 24 of the platform 26. As will be explained in more detail herein, the first platform magnet 32 is configured to magnetically attract the first zipper pull-tab 18 to a first location on the platform 26, and the second platform magnet 34 is configured to magnetically attract the second zipper pull-tab 22 to a second location on the platform 26. By way of example, as shown in FIG. 3, the first platform magnet 32 has a north polarity facing in the same direction as the outer platform surface 24, and has a south polarity facing away from the outer platform surface 24 and towards the interior of the backpack 10. The second platform magnet 34 has a south polarity facing in the same direction as the outer platform surface 24, and has a north polarity facing away from the outer platform surface 24 and towards the interior of the backpack 10.

In some embodiments, to facilitate magnetic attraction of the zipper pull-tabs 18, 22 and the platform 26 and to facilitate proper positioning of the zipper pull-tabs 18, 22 on the platform 26, each zipper pull-tab 18, 22 includes a respective zipper magnet.

Figure 5:
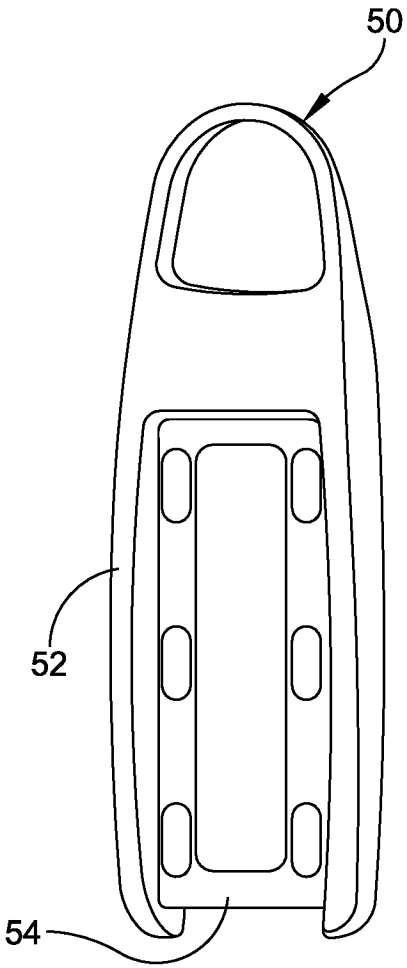
FIG. 5 is a bottom perspective view of a zipper pull-tab frame according to the disclosure.
Figure 6:
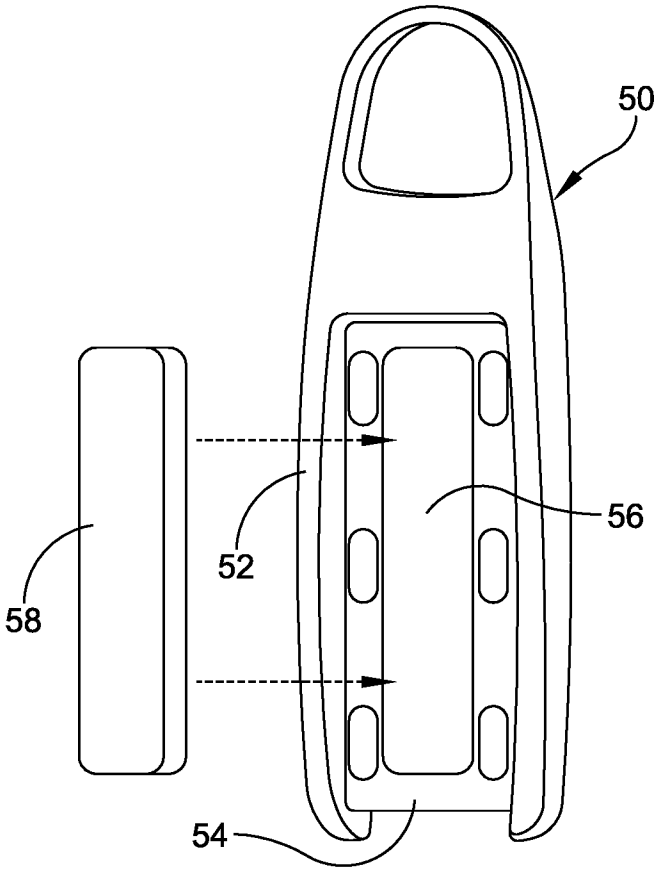
FIG. 6 is a top perspective view of the zipper pull-tab frame of FIG. 5 and a separate zipper magnet.

FIGS. 5-8 show the components of a zipper pull-tab assembly and steps of assembling a zipper pull-tab according to some embodiments of the present disclosure. FIG. 5 shows a back portion of a zipper pull-tab frame 50. FIG. 6 shows a front portion of the zipper pull-tab frame. In some embodiments, the zipper pull-tab frame 50 is formed of metal. In some embodiments, the zipper pull-tab frame 50 is formed of another material. The zipper pull-tab frame 50 includes longitudinally extending frame portions 52 and a laterally extending frame portion 54. The zipper pull-tab frame 50 may be formed integrally, for example, by casting or machining the zipper pull-tab frame 50 from an integral workpiece. In some embodiments, the zipper pull-tab frame 50 may be formed by joining two or more of the frame portions such as front and back portions together, for example by welding the two or more frame portions together.

Figure 7:
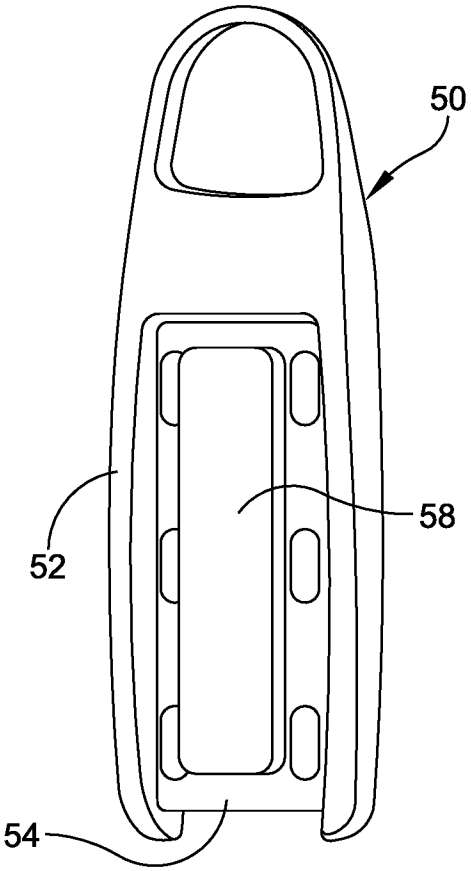
FIG. 7 is a top perspective view of the zipper pull-tab frame and zipper magnet of FIG. 6, with the zipper magnet secured to the zipper pull-tab frame.

As shown in FIG. 6, the laterally extending frame portion 54 of the front of the zipper pull-tab frame 50 includes a surface 56 that is configured to receive and support a zipper magnet 58. The zipper magnet 58 can be coupled to the surface 56 of the zipper pull-tab frame 50, for example by an adhesive, by a friction fit, or by another method of securing the magnet to the first planar surface. Referring to FIG. 7, the zipper magnet 58 is shown as secured to the surface 56 of the zipper pull-tab frame 50.

Figure 8:
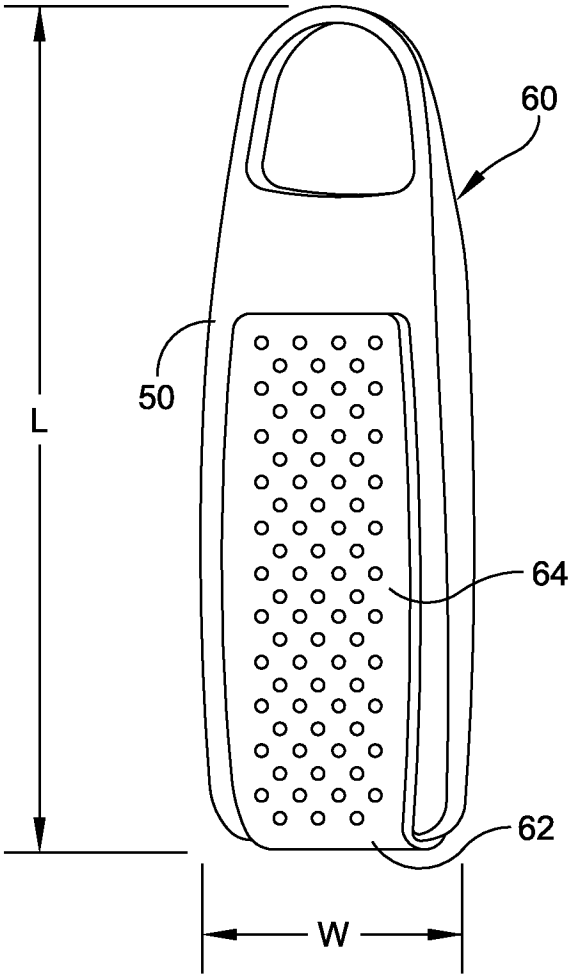
FIG. 8 is a top perspective view of a fully formed pull-tab, with overmolding extending over the zipper magnet and zipper pull-tab frame of FIG. 7.

Referring to FIG. 8, an embodiment of a fully assembled zipper pull-tab is shown. In particular, the zipper magnet 58 is enclosed within the zipper pull-tab body, indicated generally at 60, by a gripping surface 62 that extends over the zipper magnet 58 and at least a portion of the zipper pull-tab frame 50. In some embodiments, the gripping surface 62 is an overmolding. In some embodiments, the gripping surface includes rubber or another material that can be easily gripped by an individual's fingers. In some embodiments, the rubber is embossed. In the embodiment of FIG. 8, the zipper pull-tab frame 50 is a smooth metal surface, and the gripping surface 62 is an overmolded rubber. The overmolding includes a textured surface 64 to make it easier for an individual to use his or fingers to grip the overmolding 62 of the zipper pull-tab.

Thus, in an embodiment, a zipper magnet is included within the zipper pull-tab body. The zipper pull-tab body includes a zipper pull-tab frame portion. The zipper pull-tab body includes a gripping surface, which covers the zipper magnet and a portion of the zipper pull-tab frame. In some embodiments, the gripping surface is an embossed rubber material that is secured to the zipper pull-tab frame portion.

In some embodiments, the magnetic field of the zipper magnet 58 in each respective zipper pull-tab is oriented such that its magnetic field aligns the zipper pull-tab so that the platform holds each zipper pull-tab perpendicular to the zipper tape when the zipper pull-tab is magnetically held against the outer surface of the platform. In one embodiment a length L of the zipper pull-tab is oriented along a length of the platform and a width dimension W of the zipper pull-tab is oriented along a width of the platform when the zipper pull-tab is magnetically held against the outer surface 24 of the platform. In some embodiments, the length L dimension of each zipper pull-tab is oriented substantially perpendicular to the zipper tape. In some embodiments, the length L dimension of each zipper pull-tab is oriented perpendicular to the zipper tape.

In the embodiment of FIG. 1, each zipper pull-tab 18, 22 has a zipper pull-tab magnet, and the zipper pull-tab magnets are oriented in opposite directions so as mate with respective platform magnets in the platform so that the zipper pull-tabs are magnetically held against the platform by the respective zipper magnet and the platform magnet.

The operation of the magnets to facilitate a specific orientation of the zipper pull-tabs 18, 22 on the platform 26 will now be described. Positioning of each zipper pull-tab in a specific location on the platform can be accomplished by having opposite polarity of the platform magnets and by having opposite polarity of the zipper pull-tabs. For example, a first platform magnet has a north polarity facing in the same direction as the outer platform surface. A second platform magnet has a south polarity facing the same direction as the outer platform surface. A first zipper pull-tab is configured to be seated in a location near the first platform magnet. The first zipper pull-tab has a zipper magnet that has a south polarity facing towards the north polarity of first platform magnet so that the first zipper pull-tab can be seated and longitudinally aligned in a location near the first platform magnet. A second zipper pull-tab is configured to be seated in a location near the second platform magnet. The second zipper pull-tab has a zipper magnet that has a north polarity facing towards the south polarity of the second platform magnet so that the second zipper pull-tab is seated and longitudinally aligned in a location near the second platform magnet.

With this arrangement, the platform has a first location on the outer platform surface near the first platform magnet. The first location is configured for supporting the first zipper pull-tab. The platform also has a second location on the outer platform surface near the second platform magnet. The second location is configured for supporting the second zipper pull-tab.

With this arrangement, when a user pulls the first zipper pull-tab towards the platform, and rotates the zipper pull-tab towards the platform, the magnetic force between the first platform magnet and the first zipper magnet acts to draw the first zipper pull-tab to a seated position in the first location on the platform. In this way, the first zipper pull-tab is magnetically held near the first platform magnet. Likewise, if a user attempts to place the first zipper pull-tab in the second location, the second platform magnet acts to repel the first zipper pull-tab. Similarly, in this way, the second zipper pull-tab is magnetically held near the second platform magnet.

In the illustrated embodiment, the spacing between the platform magnets below the platform is such that, when one of the zipper pull-tabs is seated on the platform, there is room for the other zipper pull-tab to be subsequently seated on the platform, so the zipper arrangement is in a closed condition. In particular, with the first zipper pull-tab seated in the first location on the platform, a user pulls the second zipper pull-tab towards the platform, and rotates the second zipper pull-tab towards the platform. The magnetic force between the second platform magnet and the second zipper magnet act to draw the second zipper pull-tab to a seated position in the second location on the platform that is in close proximity to the first zipper pull-tab on the platform so as to substantially close the zippered pocket.

The order in which a user brings the first zipper pull-tab and second zipper pull-tab into engagement with the platform does not matter. It can be reversed. As with the first zipper pull-tab and the second platform magnet, the first platform magnet is configured to act to repel the second zipper pull-tab from being seated in the first location on the platform.

In some embodiments, the means for holding each zipper pull-tab in a substantially perpendicular arrangement to the zipper tape includes a magnetic means and/or another means. In some embodiments, the magnetic means relies on a magnetic force from a permanent magnet, a non-permanent magnet, and/or an electromagnet. In some embodiments, each zipper pull-tab can be held in engagement with an outer surface of the platform by a magnetic force due to a positioning magnet of the platform and a zipper magnet of the zipper pull-tab.

In some embodiments, each zipper pull-tab is magnetically attracted to a specific location on the platform.

Figure 9:
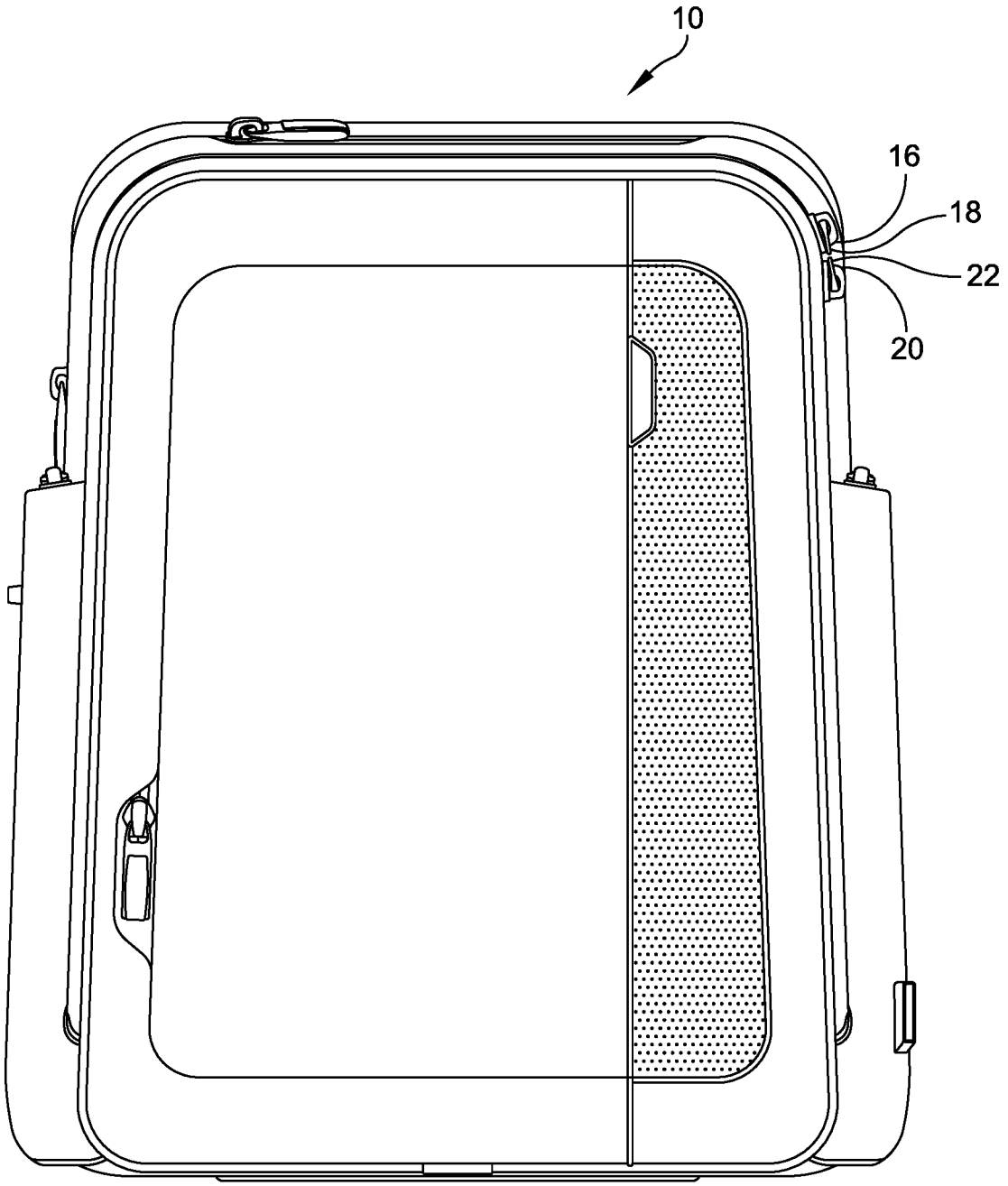
FIG. 9 is a front view of the backpack of FIG. 1.

FIG. 9 shows a front view of the embodiment of the backpack 10 of FIG. 1. As illustrated, the platform 26 is disposed on a side surface of the backpack 10 so that it out of the way and not readily seen from the front view of the bag. The first zipper pull-tab 18 and the second zipper pull-tab 22 are magnetically held against the surface 24 of the platform 26 so that the first zipper pull-tab 18 and the second zipper pull-tab 22 do not hang freely from the side of the backpack 10. It is appreciated that one advantage of the zip puller retention arrangement is that the zipper pull-tabs can be held against a surface of the bag, and as seen in this front view can be held so as to not be noticeable.

In some embodiments, a platform and at least one zipper pull-tab according to the present disclosure may be provided separately from a luggage article. The platform and the zipper pull-tab(s) may be subsequently secured to a luggage article. In some embodiments, the present disclosure provides a luggage article that incorporates a platform and at least one zipper pull-tab according to the present disclosure.

In some embodiments, the zipper arrangement includes at least two zipper sliders and at least two zipper pull-tabs, and each of the at least two zipper sliders is joined to a respective one of the at least two zipper pull-tabs.

Each zipper pull-tab is magnetically securable to a mating magnetic platform on the outer surface of a luggage article. In some embodiments, when the zipper pull-tab is magnetically held against the platform, the zipper pull-tab extends perpendicularly to the direction of the zipper tape.

When the zipper arrangement only includes one zipper pull-tab, and when the platform is located at an end of the zipper tape, the platform is configured to securely hold the zipper pull-tab, so the zipper arrangement is in a closed condition. When the zipper arrangement includes two zipper pull-tabs, the platform is configured to securely hold the zipper pull-tabs on the platform, so the zipper arrangement is in a closed condition. Through a quick visual inspection of the platform, an individual can determine whether the zipper arrangement is in a closed condition.

In some embodiments in which the zipper arrangement includes two zipper pull-tabs, the first zipper pull-tab is magnetically attracted to a first location on the platform and is magnetically repelled from a second location on the platform based on the magnetic polarity of the platform magnets. In some embodiments, the second zipper pull-tab is magnetically repelled from the first location on the platform and is magnetically attracted to the second location on the platform. In this way, a user can bring each zipper pull-tab sufficiently near the platform such that the magnetic fields of a respective magnet in the platform and a respective magnet in the zipper pull-tab act to correctly seat the respective zipper pull-tab. The correct seating of the respective zipper pull-tab causes the respective zipper pull-tab to be magnetically held in either the first location on the platform or the second location on the platform, whichever is the predetermined location for that respective zipper pull-tab.

The platform and zipper pull-tabs of the present disclosure can be applied to various luggage articles each having one or more openings secured by a zipper. For example, the platform and the zipper pull-tabs can be applied to a luggage article that is in the form of a suitcase, a backpack, a handbag, a messenger bag, a duffel bag, a sports equipment bag, a briefcase, a business case, a laptop case, or a similar case having an opening secured by zipper. In some embodiments, the luggage article includes wheels. For example, in some embodiments, the luggage article is a suitcase that has wheels.

The luggage article can include a body that has a soft shell, a hard shell, or a combination of hard shell and soft-shell portions. The luggage article can include a body having one of a variety of shapes. For example, in some embodiments, the body of the luggage article has a cuboid shape, a rectangular solid shape, a curved shape, or another shape.

The luggage article includes an outer surface. At least one interior portion is accessible via a zippered opening. In some embodiments, at least one interior portion includes an inner lining.

In another aspect of the present disclosure, a method of assembling a luggage article described above is provided. Some embodiments of the method include providing a body having an outer surface, the body including a zippered opening that has at least one zipper arrangement having a zipper tape. The zipper arrangement includes at least two zipper sliders and at least two zipper pull-tabs. Each of the at least two zipper sliders is joined to a respective one of the at least two zipper pull-tabs. The at least two zipper pull-tabs include a first zipper pull-tab and a second zipper pull-tab. Some embodiments of the method further include providing means for holding the at least two zipper pull-tabs in a substantially perpendicular arrangement to the zipper tape of the zipper arrangement.

The embodiments of the platform and zipper pull-tab of the present disclosure provide several advantages over the prior art. For example, the magnetic engagement of the platform and zipper pull-tab facilitates a specific alignment of the zipper pull-tabs on the luggage article. With this arrangement, a user can easily align at least one zipper pull-tab, so it extends perpendicularly to the zipper tape of the zippered opening. In some embodiments, a user can align two zipper pull-tabs so they extend perpendicularly to the zipper tape of the zippered opening. With this arrangement, a user can align and retain two zipper pull-tabs in a side-by-side alignment of the zipper pull-tabs and substantially perpendicular to the zipper tape on the luggage article when the zipper pull-tabs are not use. Advantages of such an arraignment are that the zipper pulls tabs are easy to use and are retained in a location and an orientation that is fixed and out of the way. Still another advantage of this arrangement is that it can be used with a zipper tape that is not metal as there need not be any magnetic attraction between the zipper pull-tabs and metal teeth of the zipper tape.

In some embodiments, a user can leave one of the zipper pull-tabs in perpendicular alignment with the zipper tape, while the user moves the other zipper pull-tab to an open position, so the user can access an interior of the luggage article. If the user wants to open the zippered opening wider, the user can move both zipper pull-tabs away from the platform, and move the zipper pull-tabs along the zippered opening to fully open the zippered opening. When the user is ready to close the zippered opening of the luggage article, the user can align the zipper pull-tabs on the platform. In some embodiments, the magnets of the platform and the zipper pull-tabs are configured so that each zipper pull-tab correctly seats itself in the proper position on the platform to leave room for the other zipper pull-tab to seat itself on the platform without requiring the first zipper pull-tab to be repositioned on the platform.

The platform and zipper pull-tabs of the present disclosure provide increased security of a zippered opening. Because the zipper pull-tabs are held in magnetic engagement with the platform, the zipper pull-tabs are more likely to retain the zippered opening in a closed position if an opening force is applied to a panel of the luggage article. This increased security is provided without requiring a lock. Individuals with limited finger dexterity may find it difficult to open locks, such as Transportation Security Administration (TSA) approved locks or other luggage locks. In some embodiments, the magnetic force that holds the zipper pull-tabs against the platform is configured such that a person with limited finger dexterity can easily disengage the zipper pull-tabs from the platform.

The platform and zipper pull-tabs of the present disclosure also provide benefits for individuals who have limited vision. A person with limited vision may find it difficult to insert a portion of a zipper pull-tab into a slot of a lock. The platform and zipper pull-tabs of the present disclosure allow an individual with limited vision to easily align the zipper pull-tabs in a secure position on the platform. The user can easily locate the platform adjacent to the zippered opening, particularly in embodiments in which the platform has a ridge along its perimeter. When the individual moves the zipper pull-tabs near the platform, a magnetic force causes the zipper pull-tab to be aligned in adjacent facing relation with the platform. When the individual wishes to open the zippered opening, the individual does not need to enter a lock code. Nor does the individual need to locate and press any small buttons before opening the zippered opening.

The platform and zipper pull-tabs of the present disclosure provide a zippered opening that can include a plurality of zipper pull-tabs while maintaining an improved aesthetic appearance of the luggage, and a cleaner arrangement of the zipper pull-tabs As described above, the zip puller arrangement of the present disclosure provides various advantages, such as making it easier for a user to find the zip pull-tabs, keeping the zip pull-tabs out of the way, and also of preventing (or at least restricting) the zip pull-tabs from swinging around and perhaps hitting things causing damage to the bag and other objects in use. The zip puller arrangement of the present disclosure assists in keeping the pull-tabs retained. Additionally, the platform provides a reinforced place on the bag where the pull-tabs will not cause damage. Retaining the pull-tabs so they are perpendicular to the zipper tape also makes it easier for a user to grip the pull-tabs and prevents the zip pull-tabs from damaging the zip tape.

According to an aspect of the present disclosure, there is provided an improved luggage article as described in the accompanying claims.

While the disclosed subject matter is described herein in terms of certain exemplary embodiments, those skilled in the art will recognize that various modifications and improvements can be made to the disclosed subject matter without departing from the scope thereof. As such, the particular features claimed below and disclosed above can be combined with each other in other manners within the scope of the disclosed subject matter such that the disclosed subject matter should be recognized as also specifically directed to other embodiments having any other possible permutations and combinations. It will be apparent to those skilled in the art that various modifications and variations can be made in the systems and methods of the disclosed subject matter without departing from the spirit or scope of the disclosed subject matter. Thus, it is intended that the disclosed subject matter include modifications and variations that are within the scope of the appended claims and their equivalents.

What is claimed:

1. A zip puller retention arrangement comprising:

a zipper arrangement having a zipper tape;

at least one zipper slider including a first zipper slider coupled to the zipper tape;

at least one zipper pull-tab including a first zipper pull-tab coupled to the first zipper slider; and a means for holding the first zipper pull-tab in a fixed position when not in use so that the first zipper pull-tab is held in a substantially perpendicular arrangement to the zipper tape of the zipper arrangement, the means for holding including a platform having a first positioning magnet coupled to an inner surface of the platform.

2. The zip puller retention arrangement of claim 1, wherein the first pull-tab includes a first zipper magnet, and the platform and the first pull-tab are configured so that the first zipper magnet is held in engagement with an outer surface of the platform by a first magnetic force.

3. The zip puller retention arrangement of claim 2, wherein the platform is mounted to a luggage article proximate to a zippered opening, the luggage article including a body having an outer surface, the body including the zippered opening secured by the zipper tape.

4. The zip puller retention arrangement of claim 3, wherein the platform is secured to the outer surface of the body, preferably by one of stitching and an adhesive.

5. The zip puller retention arrangement of claim 3, wherein the platform is mounted to a side panel of the outer surface of the body.

6. The zip puller retention arrangement of claim 3, wherein the luggage article includes an inner lining that is secured to an inner surface of the body, with the first positioning magnet being disposed between the inner surface of the platform and the inner lining.

7. The zip puller retention arrangement of claim 3, wherein the luggage article is any of a suitcase, a backpack, a briefcase, a handbag, a messenger bag, a duffel bag, and a sports equipment bag.

8. The zip puller retention arrangement of claim 1, wherein the platform has a ridge along a portion of a perimeter of the platform with the ridge extending outwardly beyond an outer surface of the platform.

9. The zip puller retention arrangement of claim 8, wherein the platform has four sides, wherein three of the four sides include the ridge and a fourth side of the four sides does not.

10. The zip puller retention arrangement of claim 1, further comprising at least two zipper sliders including the first zipper slider and a second zipper slider; and at least two zipper pull-tabs including the first zipper pull-tab and a second zipper pull-tab, each of the at least two zipper sliders joined to a respective one of the at least two zipper pull-tabs, and the first zipper pull-tab being coupled to a first zipper magnet and the second zipper pull-tab being coupled to a second zipper magnet.

11. The zip puller retention arrangement of claim 10, wherein the platform includes at least two positioning magnets coupled to the inner surface of the platform, the at least two positioning magnets including the first positioning magnet and a second positioning magnet, the at least two zipper pull-tabs and the platform being configured so that the first zipper magnet is held in engagement with an outer surface of the platform by a first magnetic force between the first zipper magnet and the first positioning magnet, and the second zipper magnet is held in engagement with the outer surface of the platform by a second magnetic force between the second zipper magnet and the second positioning magnet.

12. The zip puller retention arrangement of claim 11, wherein the first positioning magnet has a first polarity and the first zipper magnet has a second polarity opposite to the first polarity, and the second positioning magnet has the second polarity and the second zipper magnet has the first polarity.

13. The zip puller retention arrangement of claim 11, wherein each zipper pull-tab comprises an elongated body having a longitudinal axis that extends substantially perpendicular to an edge of a zippered opening when the respective zipper pull-tab is held in engagement with the outer surface of the platform.

14. The zip puller retention arrangement of claim 11, wherein each zipper pull-tab includes a pull-tab frame, a respective one of the zipper magnets being coupled to the pull-tab frame, and a gripping surface disposed over the respective one of the zipper magnets and the pull-tab frame.

15. The zip puller retention arrangement of claim 14, wherein each zipper magnet is coupled to the pull-tab frame by one or more of a friction fit and an adhesive.

16. The zip puller retention arrangement of claim 14, wherein the gripping surface includes rubber.

17. The zip puller retention arrangement of claim 14, wherein each pull-tab frame includes metal.

18. The zip puller retention arrangement of claim 11, wherein the platform has a ridge along a portion of a perimeter of the platform, with the ridge extending outwardly beyond the outer surface of the platform.

19. The zip puller retention arrangement of claim 18, wherein the platform has four sides, wherein three of the four sides include the ridge and a fourth side of the four sides does not.

20. The zip puller retention arrangement of claim 18, wherein the platform is sized and configured so that a first side of the first zipper pull-tab engages with the outer surface of the platform and so that a first side the second zipper pull-tab engages with the outer surface of the platform so that the ridge substantially surrounds a periphery of the first zipper pull-tab and the second zipper pull-tab.

* * * * *